US007735444B1

(12) United States Patent
Fox

(10) Patent No.: US 7,735,444 B1
(45) Date of Patent: Jun. 15, 2010

(54) BOARDING AID FOR ASSISTING EMBARKING ON OR DEBARKING FROM AN INFLATABLE DINGHY

(76) Inventor: Stephen I. Fox, 405 N. Midland Ave., Nyack, NY (US) 10960

( * ) Notice: Subject to any disclaimer, the term of this patent is extended or adjusted under 35 U.S.C. 154(b) by 0 days.

(21) Appl. No.: 12/487,759

(22) Filed: Jun. 19, 2009

(51) Int. Cl.
*B63B 17/00* (2006.01)

(52) U.S. Cl. ..... 114/362

(58) Field of Classification Search ..... 114/343, 114/361, 363, 364, 362, 345
See application file for complete search history.

(56) References Cited

U.S. PATENT DOCUMENTS 468,960 A 2/1892 Vondersaar
2,571,282 A * 10/1951 Newton et al. ..... 297/252
4,074,379 A 2/1978 Grossman et al.
5,005,255 A 4/1991 Pare et al.
5,154,134 A * 10/1992 Goldsmith ..... 114/345
5,269,044 A 12/1993 Marion
5,662,060 A 9/1997 Lemke
5,788,133 A 8/1998 Mareno
6,796,863 B1 9/2004 Oathout
7,125,079 B1 * 10/2006 Lee et al. ..... 297/353
2007/0068443 A1 3/2007 Zochert

* cited by examiner

*Primary Examiner*—Ed Swinehart
(74) *Attorney, Agent, or Firm*—Arthur Jacob

(57) ABSTRACT

A boarding aid assists a person in embarking on and disembarking from a deployed inflatable dinghy over the bow of the dinghy. A handgrip bar is supported by a support structure selectively coupled with the dinghy so as to be placed over the bow of the dinghy, with the handgrip bar spaced above the bow at an elevated position which renders the handgrip accessible for ready grasping by a person remaining essentially erect as the person steps aboard or leaves the dinghy. Upon selective uncoupling of the support structure from the dinghy, the support structure and the handgrip bar will be released for stowing apart from the dinghy.

15 Claims, 4 Drawing Sheets

BOARDING AID FOR ASSISTING EMBARKING ON OR DEBARKING FROM AN INFLATABLE DINGHY

The present invention relates generally to inflatable dinghies and pertains, more specifically, to a boarding aid for assisting a person in embarking on or disembarking from a deployed inflatable dinghy.

Boating has grown in popularity and currently is engaged in by a very large number of people throughout the world. In particular, boaters enjoy visiting a variety of ports, many of which provide mooring facilities that require the boater to employ some other form of conveyance when traveling from a moored boat to shore, and subsequently back to the boat. By far, the most ubiquitous conveyance for that use is an inflatable dinghy carried or towed by the boat and deployed as needed.

While, in general, inflatable dinghies are convenient to use and provide a high degree of safety, boarding an inflatable dinghy, as well as exiting from the dinghy, can present a challenge, especially to children and older passengers who may not be as sure-footed and confident as other passengers. Inflatable dinghies are somewhat skittish on the water, and when tied to a fixed dock usually are at various elevations with respect to the dock, especially in tidal waters. Accordingly, there is a need for an aid which can be made available readily to assist a person during embarking on and debarking from an inflatable dinghy, especially when tied to a dock, and is relatively unobtrusive during use of the dinghy, as well as when the dinghy is stowed aboard a boat, ready for deployment, as required.

In an earlier application Ser. No. 12/409,558, filed by me on Mar. 24, 2009, the disclosure of which is incorporated herein by reference thereto, there is described a boarding aid for inflatable dinghies wherein an inflatable dinghy is tied to a dock with a side of the dinghy juxtaposed with the dock such that a passenger boards or leaves the dinghy over the side of the dinghy. In that arrangement, the boarding aid is placed at a location spaced from the bow and from the stern of the dinghy, the preferred location being substantially amidships. However, at many mooring facilities, the population of dinghies requiring docking space becomes so great that the available docking space is insufficient to accommodate enough dinghies, were those dinghies to be tied to a dock along the sides of the dinghies. In that event, dinghies are tied to the dock in a "bow-in" orientation, that is, with the bow of each dinghy placed alongside the dock, rather than with the side of the dinghy so placed. Since the beam of a dinghy is much less than the length of the dinghy, the bow-in orientation conserves dock space and enables the accommodation of greater numbers of dinghies at a particular dock.

When a dingy is tied to a dock in the bow-in orientation, embarking and debarking are accomplished over the bow of the dinghy. Accordingly, there is a need for a boarding aid which can assist a passenger in boarding and leaving an inflatable dinghy over the bow of the dinghy. The present invention provides just such a boarding aid and, as such, attains several objects and advantages, some of which are summarized as follows: Provides a handgrip having extended dimensions and being placed in an inflatable dingy, located and oriented for convenient grasping to assist a person in boarding or leaving the dinghy at the bow of the dinghy; enables a passenger to embark upon or debark from an inflatable dinghy over the bow of the dinghy while maintaining a confident and sure-footed posture for reducing apprehension and increasing safety, especially where the dinghy is at various elevations with respect to a dock in tidal waters; maintains a high degree safety while a passenger boards or leaves an inflatable dinghy at the bow of the dinghy; allows quick and convenient attachment of a handgrip to an inflatable dinghy at the bow of the dinghy upon deployment of the dinghy, while enabling ease of detachment upon stowing of the dinghy; is unobtrusive during use of the dinghy and compact for ready storage when the dinghy is stowed; provides a highly stable and reliable attachment to an inflatable dinghy adjacent the bow of the dinghy while protecting the dinghy from excessive stresses and concomitant damage at various points of attachment; provides a relatively inexpensive construction, readily fitted to current inflatable dinghies of various dimensions for encouraging widespread adoption and use; is installed readily on an existing inflatable dinghy without requiring special tools or special skills; promotes boating safety and convenience for an enhanced boating experience over a wider audience of boaters; provides a rugged construction, resistant to wear and corrosion, for exemplary performance over an extended service life.

The above objects and advantages, as well as further objects and advantages, are attained by the present invention which may be described briefly as a boarding aid for assisting a person in embarking on and disembarking from a dinghy having a bow, adjacent inflatable pontoon bow sections spaced apart in lateral directions by a predetermined lateral distance, and a floor extending laterally between the pontoon bow sections, the pontoon bow sections extending altitudinally upward from the floor to corresponding upper edges located at a predetermined height above the floor, the boarding aid comprising: a handgrip bar having a length extending between opposite bar portions, a support structure having a first support portion for juxtaposition with the pontoon bow sections, and a second support portion spaced from the first support portion along a longitudinal direction, the support structure being joined with the handgrip bar adjacent the second support portion of the support structure such that the handgrip bar extends laterally with respect to the longitudinal direction of the support structure; and a coupling arrangement for coupling the first support portion of the support structure with the dinghy at a corresponding coupling location juxtaposed with the bow, the coupling arrangement including a lateral member for extending laterally between the pontoon bow sections, the lateral member having laterally opposite ends, and a pair of couplings, each coupling of the pair of couplings being configured and dimensioned for securement to a corresponding pontoon bow section at the corresponding coupling location; the coupling arrangement including a coupling member on the lateral member at a coupling location intermediate the ends of the lateral member, the coupling member being configured and dimensioned for securing the first support portion of the support structure to the lateral member with the support structure fixed against movement relative to the lateral member; the support structure having a prescribed length between the first and second support portions, and each coupling being configured and oriented such that with the first support portion of the support structure coupled with the coupling member, the support structure is installed on the dinghy, fixed against movement relative to the lateral member, with the length of the handgrip bar extending laterally essentially in alignment with the lateral directions and placed at an elevated position located a substantial altitudinal distance above the bow, so as to be accessible for ready grasping by a person remaining essentially erect as the person steps aboard or debarks from the dinghy adjacent the bow.

In addition, the present invention provides a boarding aid for assisting a person in embarking on and disembarking from a dinghy having a bow, adjacent inflatable pontoon bow sections spaced apart in lateral directions by a predetermined lateral distance, a floor extending laterally between the pontoon bow sections, the pontoon bow sections extending altitudinally upward from the floor to corresponding upper edges located at a predetermined height above the floor, and a platform secured to the dinghy adjacent the bow, the platform extending laterally between the pontoon bow sections and having laterally opposite ends, the boarding aid comprising: a handgrip bar having a length extending between opposite bar portions, a support structure having a first support portion for juxtaposition with the pontoon bow sections, and a second support portion spaced from the first support portion along a longitudinal direction, the support structure being joined with the handgrip bar adjacent the second support portion of the support structure such that the handgrip bar extends laterally with respect to the longitudinal direction of the support structure; and a coupling arrangement for coupling the first support portion of the support structure with the dinghy at a coupling location on the platform and juxtaposed with the bow; the coupling arrangement including at least one coupling member on the platform at the coupling location, the coupling member being configured and dimensioned for securing the first support portion of the support structure to the platform with the support structure fixed against movement relative to the platform; the support structure having a prescribed length between the first and second support portions such that with the first support portion of the support structure coupled with the platform, the support structure will be installed on the dinghy, fixed against movement relative to the platform, with the length of the handgrip bar extending laterally essentially in alignment with the lateral directions and placed at an elevated position located a substantial altitudinal distance above the bow, so as to be accessible for ready grasping by a person remaining essentially erect as the person steps aboard or debarks from the dinghy adjacent the bow.

The invention will be understood more fully, while still further objects and advantages will become apparent, in the following detailed description of preferred embodiments of the invention illustrated in the accompanying drawing, in which:

FIG. 1 top plan somewhat pictorial view of an inflatable dinghy and showing a boarding aid constructed in accordance with the invention installed in the dinghy and in use;

Figure 1:
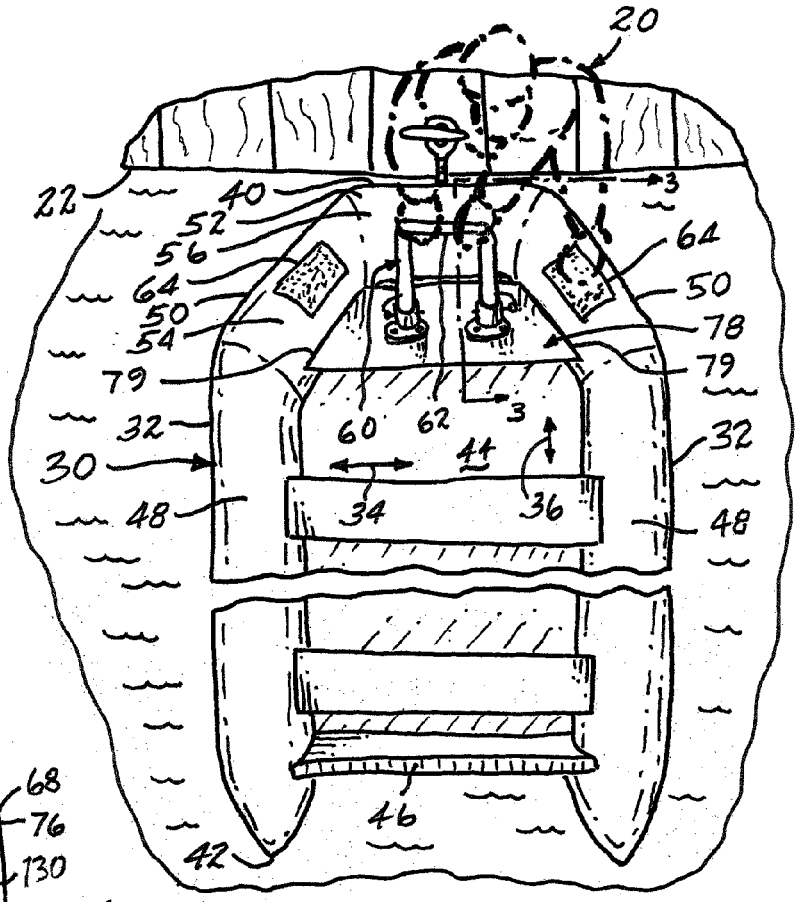
Figure 2:
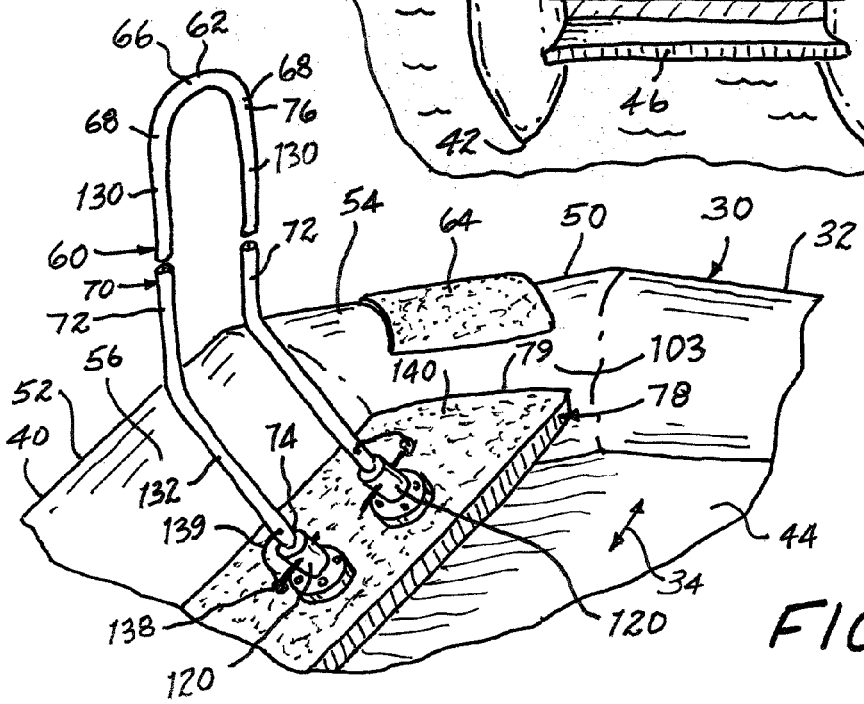
FIG. 2 is an enlarged, fragmentary pictorial view illustrating the boarding aid.

Referring now to the drawing, and especially to FIGS. 1 and 2 thereof, a person is shown in phantom at 20 in FIG. 1 stepping from a dock 22 to board an inflatable dinghy 30 tied to the dock 22. Inflatable dinghy 30 is of conventional construction, having inflated pontoon sides 32 spaced apart in lateral directions 34 and extending in forward and aft directions 36 between a bow 40 and a stern 42. A floor 44 extends laterally between the pontoon sides 32 and longitudinally between the bow 40 and the stern 42. A transom 46 extends laterally between the pontoon sides 32, adjacent the stern 42, and the pontoon sides 32 extend altitudinally upward from the floor 44 to gunwales 48. The pontoon sides 32 converge toward the bow 40, along converging inflated pontoon bow sections 50 spaced apart in the lateral directions 34 by diminishing predetermined lateral distances as the bow sections 50 converge toward the bow 40 which, in the illustrated dinghy 30 includes a lateral bow section 52. The converging bow sections 50 and the lateral bow section 52 extend altitudinally upwardly from the floor 44 to respective upper edges 54 and 56.

A boarding aid constructed in accordance with the present invention is shown at 60 and is installed in dinghy 30 to provide a handgrip 62 at an elevated position located a substantial altitudinal distance above the upper edges 54 and 56 and is oriented in alignment with lateral directions 34 so as to be placed for ready grasping by the person 20 while the person 20 remains in an essentially erect posture as the person steps aboard the dinghy 30, thereby enabling a sure-footed stance and promoting confidence during boarding, and during leaving dinghy 30. That is, as the person 20 steps from the dock 22 to the dinghy 30, as seen in FIG. 1, handgrip 62 is available for ready grasping while the person 20 has a sure-footed purchase on the dock 22 and on the dinghy 30. Then, as the person 20 continues boarding and steps down into dinghy 30, handgrip 62 still is available for grasping, with two hands spread apart in lateral directions, to maintain confidence, stability and safety. Throughout the boarding process, handgrip 62 is available to enable the person 20 to remain in the essentially erect posture, for a sure-footed stance providing confidence and safety. This is particularly true where the dinghy 30 is tied to a fixed dock 22 in tidal waters where the difference in elevation between the dinghy 30 and the dock 22 may be extensive and may vary with the tide. Further, the handgrip 62 is placed at a laterally centered location and altitudinally directly over lateral bow section 52 at the bow 40 so as to maintain stability as the person 20 steps aboard the dinghy 30, or rises to leave the dinghy 30. Preferably, a boarding mat 64 of a skid-resistant material is draped over the upper edge 54 of each pontoon bow section 50, as shown, in order to enhance a sure-footed purchase as the person 20 steps upon a pontoon bow section 50.

Turning now to FIGS. 3 through 7, as well as to FIGS. 1 and 2, handgrip 62 includes a handgrip bar 66 having opposite bar portions 68 and being placed so as to be readily accessible for grasping by the person 20, as illustrated in FIG. 1. To that end, handgrip bar 66 is supported by a support structure 70, here shown in the form of a pair of standards 72. Upon erection of the support structure 70, with each standard 72 depending from a corresponding bar portion 66, the support structure 70 and the handgrip bar 66 establish a generally inverted U-shaped configuration comprised of the laterally extending handgrip bar 66 and the depending standards 72, with the support structure 70 having a prescribed length extending along a longitudinal direction between a first support portion shown in the form of a first end 74 juxtaposed with the pontoon bow sections 50, adjacent the floor 44, and a second support portion 76 juxtaposed with the handgrip bar 66. The preferred, inverted U-shaped configuration places the standards 72 in juxtaposition with corresponding pontoon bow sections 50 so as to render the boarding aid 60 readily available when approached from either pontoon bow section 50, as well as from lateral bow section 52.

Figure 4:
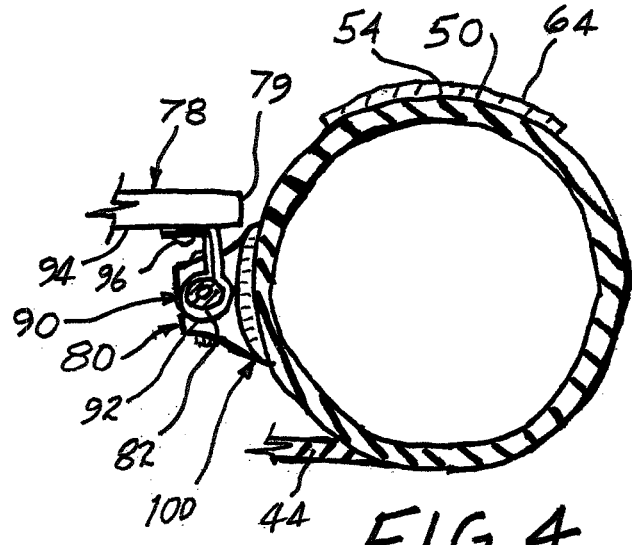
FIG. 4 is an enlarged, fragmentary cross-sectional view taken along line 4-4 of FIG. 3.
Figure 3:
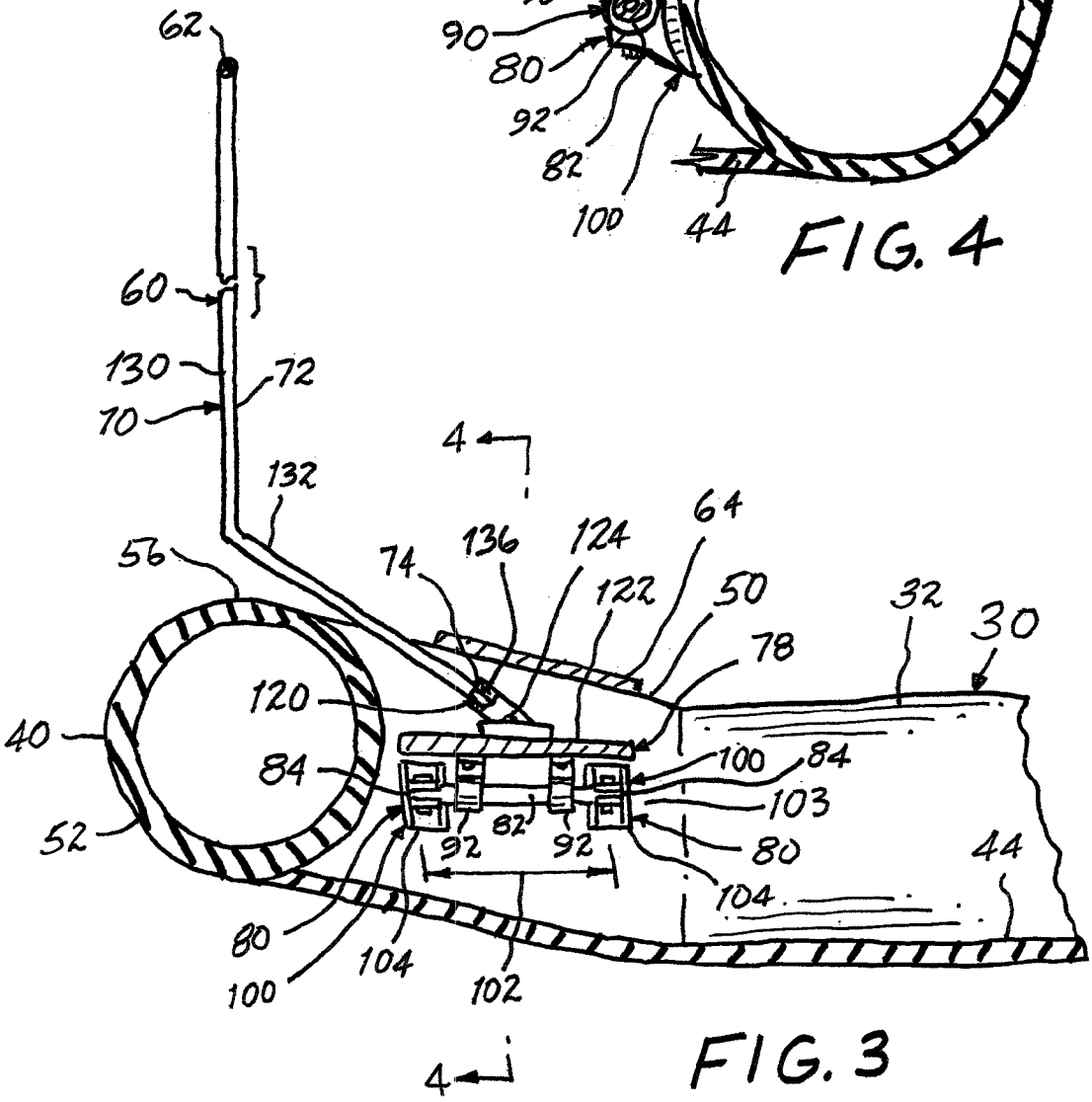
FIG. 3 is an enlarged, fragmentary cross-sectional view taken along line 3-3 of FIG. 1.

A coupling arrangement couples the first end 74 of the support structure 70 with the dinghy 30 and includes a lateral member in the form of a substantially flat platform 78 having opposite platform ends 79. A pair of couplings 80 are configured and dimensioned for affixation to a corresponding pontoon bow section 50. Thus, each coupling 80 includes a support rod 82 having a rod length between opposite rod ends 84 and a first attachment element at each rod end 84, the support rod 82 preferably being in the form of a substantially rigid tubular member 86 drilled adjacent the rod ends 84 to establish a first attachment element in the form of transverse holes 88. A support rod 82 is secured to each end 79 of platform 78, with each support rod 82 affixed to a corresponding end 79 of the platform 78 by an affixation arrangement illustrated in FIG. 3 at 90. As best seen in FIG. 4, as well as in FIG. 3, affixation arrangement 90 includes a clip 92 extending around rod 82 and secured to the underside 94 of platform 78 by a threaded fastener 96.

Each support coupling 80 further includes a pair of support members 100, each support member 100 being configured and dimensioned for affixation to the corresponding pontoon bow section 50, with the pair of support members 100 spaced apart along each respective pontoon bow section 50 by a support distance 102. Thus, each support member 100 includes a base 104, preferably constructed of an elastomeric material, such as rubber, for conforming to the cross-sectional configuration of the corresponding pontoon bow section 50. The support members 100 are affixed to the pontoon bow sections 50, as by an adhesive placed along base 104, so as to be permanently attached to the dinghy 30, at inboard locations 103.

Figure 5:
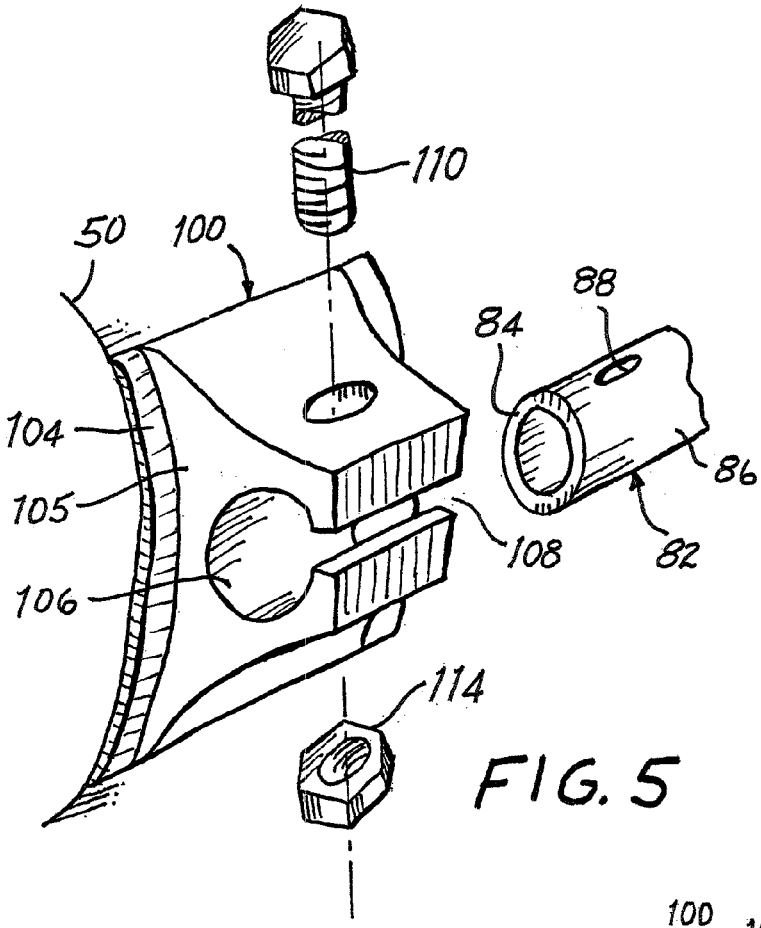
FIG. 5 is an exploded pictorial perspective view of component parts of the boarding aid.
Figure 6:
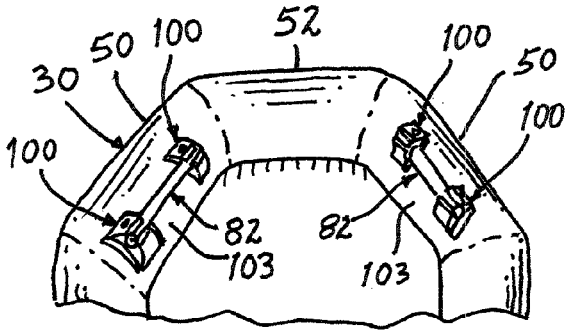
FIG. 6 is a fragmentary pictorial perspective view of a portion of the inflatable dinghy and showing component parts of the boarding aid arranged on the dinghy.

As best seen in FIG. 5, support members 100 each include a post 105, preferably constructed integral with base 104, as by molding post 105 unitary with base 104. A bore 106 passes through post 105, and post 105 is split, as shown at 108. Bores 106 are substantially complementary to rod ends 84, and rod ends 84 are inserted into corresponding bores 106 to mount each support rod 82 to a corresponding pontoon bow section 50. A bolt 110 is inserted through apertures 112 in post 104, and through aligned drilled holes 88 in each rod end 84, and a nut 114 is threaded onto each bolt 110 to secure each support rod 82 in place, with each split post 105 drawn into a tight fit with a corresponding rod end 84.

Platform 78 carries coupling members at a coupling location intermediate the platform ends 79, the coupling members being shown in the form of sockets 120 secured to upper face 122 of platform 78, as by threaded fasteners 124. Each standard 72 of support structure 70 includes segments 130 and 132 angled relative to one another, with segment 132 directed inwardly toward the stem 42 relative to segment 130 to establish an angled configuration adjacent the end 74 of support structure 70, and includes further coupling members, each in the form of a plug 136 having a configuration complementary to a corresponding socket 120. Upon insertion of each plug 136 into a corresponding socket 120, support structure 70 is coupled with platform 78, fixed against movement relative to platform 78, and boarding aid 60 is erected in dinghy 30. The angled configuration established by the angled relationship between segments 130 and 132 places handgrip 62 altitudinally directly above lateral bow section 52, rendering handgrip 62 accessible for ready grasping by person 20. Each plug 136 is secured in place within a socket 120 by passing a locking pin 138 through respective registered apertures in plugs 136 and sockets 120. Each locking pin 138 is tethered, as by tether 139, to a standard 72 for convenience as well as for safety.

With the support structure 70 coupled to platform 78 at the coupling location provided by the position of the sockets 120 on the platform 78, and the location of support rods 82 on the pontoon bow sections 50, which places the handgrip 62 at the elevated position above lateral bow section 52, stability of the dinghy 30 is assured during the embarking and disembarking of a passenger, as exemplified by person 20. Such embarking and disembarking is facilitated by locating platform 78 attitudinally intermediate the floor 44 and the upper edges 54 and 56 of bow sections 50 and 52, enabling passengers to utilize platform 78 as a convenient step. To that end, platform 78 is constructed of a substantially rigid material dimensioned and configured for providing the person 20 with a firm and stable footing upon stepping aboard or leaving the dinghy 30, and upper face 122 of platform 78 preferably is provided with an anti-slip surface 140. In addition, should the dinghy 30 be provided with a motor (not shown) attached to the transom 46, placement of the boarding aid 60 at the bow 40 avoids obstruction by the motor during boarding and exiting the dinghy 30, and allows a driver to remain in place adjacent the motor while other passengers can embark and debark freely. Moreover, the placement of platform 78 on the support rods 82, with the rod ends 84 secured to a corresponding pontoon bow section 50 by support members 100 spaced apart by support distance 102, further promotes stability of the dinghy 30 during boarding and exiting the dinghy 30. At the same time, the coupling arrangement which includes support rods 82 secured to spaced apart support members 100 distributes the load associated with supporting the boarding or exiting person 20, thus reducing the stress upon the pontoon bow sections 50 at each juncture between a support member 100 and a pontoon bow section 50, thereby better preserving the integrity of the pontoon bow sections 50. In the preferred construction, support structure 72 is constructed of a corrosion-resistant metal tubing such as, for example, stainless steel tubing. In order to place handgrip 62 at the desired elevated position, the prescribed length between first end 74 and second end support portion 76 of support structure 72 is such that the handgrip bar 62 is placed at a substantial altitudinal distance above the upper edges 54 and 56, a typical altitudinal distance being about thirty inches.

When it is desired to stow the dinghy 30, support structure 72 is easily removed from the dinghy 30 by merely withdrawing locking pins 138 and pulling plugs 136 from corresponding sockets 120, thereby releasing support structure 72, and handgrip 62, from dinghy 30 for compact storage apart from dinghy 30. Should it become necessary to release support rods 82 from dinghy 30, as for maintenance or cleaning, it becomes a simple matter to withdraw bolts 110 and move support rod ends 84 out of bores 106.

Initial installation of boarding aid 60 on an existing dinghy 30 becomes a simple procedure, involving no special tools or special skills. Support members 100 are affixed readily to pontoon bow sections 50, as by an adhesive connection, placed at readily measured locations.

Figure 7:
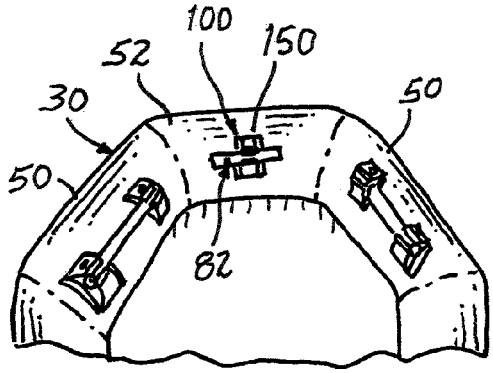
FIG. 7 is fragmentary pictorial view similar to FIG. 6 and showing an alternate arrangement.

In an alternate arrangement illustrated in FIG. 7, where lateral bow section 52 has an extended length, supplemental support for platform 78 may be provided by affixing another support member 100 to lateral bow section 52, as shown at 150. A further support rod 82 then will be affixed to the platform 78 at a location intermediate the ends 79 of the platform 78, with additional clips 92 placed adjacent each end 84 of the further support rod 82, and the further support rod 82 then will be secured to supplemental support member 100 for added support of platform 78.

Figure 8:
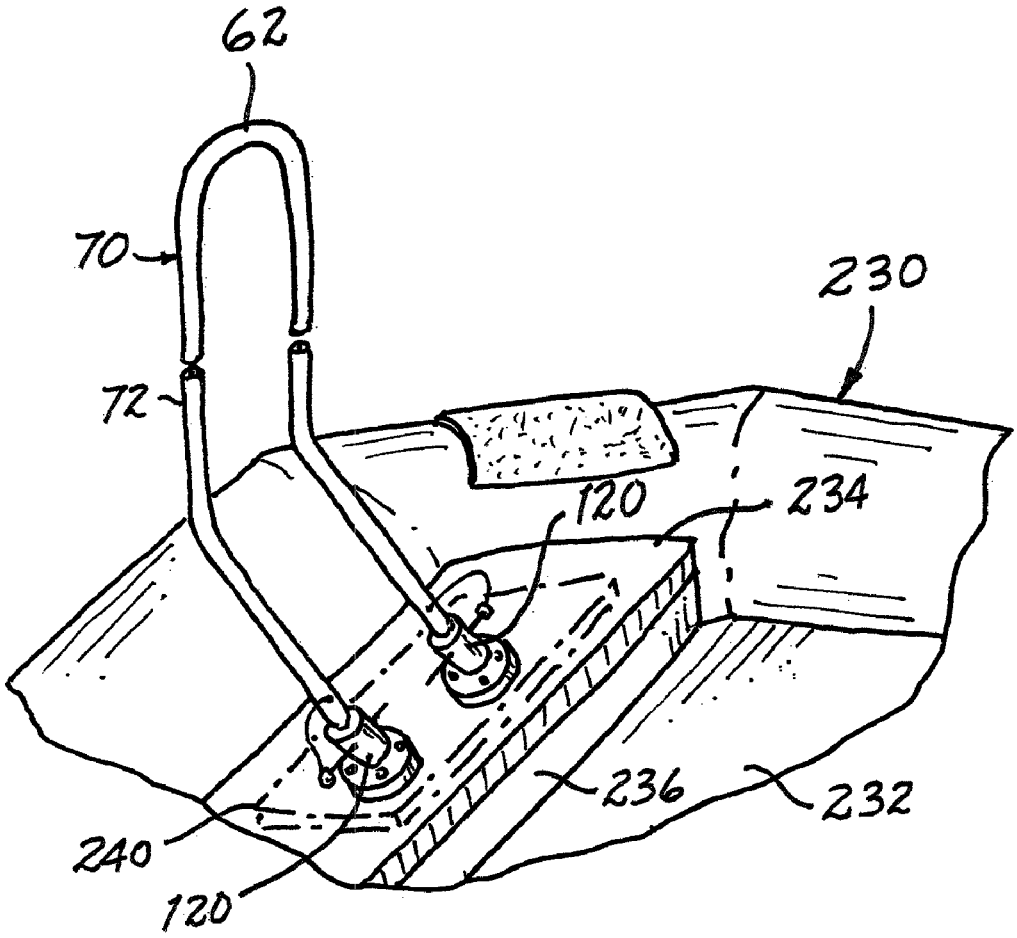
FIG. 8 is an enlarged, fragmentary pictorial view similar to FIG. 2 and illustrating another embodiment of the boarding aid.

Referring now to FIG. 8, in another embodiment of the present invention, support structure 72 is coupled at the first end 74 to dinghy 230 of the type having a rigid floor 232 and an already installed lateral member, here shown in the form of a step 234 secured in place with a riser 236. In some existing dinghies, such a step is provided as a part of a compartment built into the dinghy adjacent the bow of the dinghy. In dinghy 230, sockets 120 can be mounted directly to the already existing step 234 or to a separate pad 240 which is then affixed to step 234. Support structure 72 then is coupled with sockets 120 to secure the support structure 72 to step 234, fixed against movement relative to step 234, and to place handgrip 62 in position for assisting embarking and disembarking, as described above in connection with the embodiments illustrated in FIGS. 1 through 7. When it is desired to stow dinghy 230, support structure 72 is released easily from dinghy 230 merely by withdrawing support structure 72 from sockets 120 for compact storage apart from dinghy 230.

It will be seen that the present invention attains all of the objects and advantages summarized above, namely: Provides a handgrip having extended dimensions and being placed in an inflatable dingy, located and oriented for convenient grasping to assist a person in boarding or leaving the dinghy at the bow of the dinghy; enables a passenger to embark upon or debark from an inflatable dinghy over the bow of the dinghy while maintaining a confident and sure-footed posture for reducing apprehension and increasing safety, especially where the dinghy is at various elevations with respect to a dock in tidal waters; maintains a high degree safety while a passenger boards or leaves an inflatable dinghy at the bow of the dinghy; allows quick and convenient attachment of a handgrip to an inflatable dinghy at the bow of the dinghy upon deployment of the dinghy, while enabling ease of detachment upon stowing of the dinghy; is unobtrusive during use of the dinghy and compact for ready storage when the dinghy is stowed; provides a highly stable and reliable attachment to an inflatable dinghy adjacent the bow of the dinghy while protecting the dinghy from excessive stresses and concomitant damage at various points of attachment; provides a relatively inexpensive construction, readily fitted to current inflatable dinghies of various dimensions for encouraging widespread adoption and use; is installed readily on an existing inflatable dinghy without requiring special tools or special skills; promotes boating safety and convenience for an enhanced boating experience over a wider audience of boaters; provides a rugged construction, resistant to wear and corrosion, for exemplary performance over an extended service life.

It is to be understood that the above detailed description of preferred embodiments of the invention is provided by way of example only. Various details of design and construction may be modified without departing from the true spirit and scope of the invention, as set forth in the appended claims.

The invention claimed is:

1. A boarding aid for assisting a person in embarking on and disembarking from a dinghy having a bow, adjacent inflatable pontoon bow sections spaced apart in lateral directions by a predetermined lateral distance, and a floor extending laterally between the pontoon bow sections, the pontoon bow sections extending altitudinally upward from the floor to corresponding upper edges located at a predetermined height above the floor, the boarding aid comprising:

a handgrip bar having a length extending between opposite bar ends portions;

a support structure having a first support portion for juxtaposition with the pontoon bow sections, and a second support portion spaced from the first support portion along a longitudinal direction, the support structure being joined with the handgrip bar adjacent the second support portion of the support structure such that the handgrip bar extends laterally with respect to the longitudinal direction of the support structure; and a coupling arrangement for coupling the first support portion of the support structure with the dinghy at a corresponding coupling location juxtaposed with the bow, the coupling arrangement including a lateral member for extending laterally between the pontoon bow sections, the lateral member having laterally opposite ends, and a pair of couplings, each coupling of the pair of couplings being configured and dimensioned for securement to a corresponding pontoon bow section at the corresponding coupling location;

the coupling arrangement including a coupling member on the lateral member at a coupling location intermediate the ends of the lateral member, the coupling member being configured and dimensioned for securing the first support portion of the support structure to the lateral member with the support structure fixed against movement relative to the lateral member;

the support structure having a prescribed length between the first and second support portions, and each coupling being configured and oriented such that with the first support portion of the support structure coupled with the coupling member, the support structure is installed on the dinghy, fixed against movement relative to the lateral member, with the length of the handgrip bar extending laterally essentially in alignment with the lateral directions and placed at an elevated position located a substantial altitudinal distance above the bow, so as to be accessible for ready grasping by a person remaining essentially erect as the person steps aboard or debarks from the dinghy adjacent the bow.

2. The boarding aid of claim 1 wherein the support structure includes support segments angled relative to one another to locate the handgrip bar altitudinally above the bow of the dinghy when the boarding aid is coupled to the dinghy.

3. A boarding aid for assisting a person in embarking on and disembarking from a dinghy having a bow, adjacent inflatable pontoon bow sections spaced apart in lateral directions by a predetermined lateral distance, and a floor extending laterally between the pontoon bow sections, the pontoon bow sections extending altitudinally upward from the floor to corresponding upper edges located at a predetermined height above the floor, the boarding aid comprising:

a handgrip bar having a length extending between opposite bar portions;

a support structure having a first support portion for juxtaposition with the pontoon bow sections, and a second support portion spaced from the first support portion along a longitudinal direction, the support structure being joined with the handgrip bar adjacent the second support portion of the support structure such that the handgrip bar extends laterally with respect to the longitudinal direction of the support structure; and a coupling arrangement for coupling the first support portion of the support structure with the dinghy at a corresponding coupling location juxtaposed with the bow, the coupling arrangement including a lateral member for extending laterally between the pontoon bow sections, the lateral member having laterally opposite ends, and a pair of couplings, each coupling of the pair of couplings being configured and dimensioned for securement to a corresponding pontoon bow section at the corresponding coupling location;

the support structure having a prescribed length between the first and second support portions, and each coupling being configured and oriented such that with the first support portion of the support structure coupled with a corresponding coupling, the support structure is installed on the dinghy with the handgrip bar extending laterally essentially in alignment with the lateral directions and placed at an elevated position located a substantial altitudinal distance above the bow, so as to be accessible for ready grasping by a person remaining essentially erect as the person steps aboard or debarks from the dinghy adjacent the bow;

each coupling including:

a support rod having a rod length between opposite rod ends, and a first attachment element at each rod end;

a pair of support members, each support member being configured and dimensioned for affixation to a corresponding pontoon bow section at an affixation position on the pontoon bow section with the pair of support members spaced apart along the corresponding pontoon bow section by a support distance;

each support member having a second attachment element for engaging a corresponding first attachment element to secure the support rod to the corresponding pontoon bow section; and a coupling member on the lateral member at a coupling location intermediate the ends of the lateral member for coupling the support structure to the lateral member, such that affixation stresses at the affixation positions will be distributed among the spaced apart affixation positions while the support distance and the coupling location will promote stability during embarking and disembarking.

4. The boarding aid of claim 3 wherein the coupling arrangement includes a further coupling member carried by the support structure at the second first support portion of the support structure, the further coupling member being complementary to the coupling member on the lateral member for enabling selective coupling and uncoupling of the support structure and the lateral member such that upon selective uncoupling of the first support portion of the support structure from the lateral member, the support structure and the handgrip bar will be released for stowing apart from the dinghy.

5. The boarding aid of claim 3 wherein the support structure includes a pair of standards, each standard depending from the handgrip bar at a corresponding bar portion such that the support structure follows a generally inverted U-shaped configuration upon erection of the boarding aid.

6. The boarding aid of claim 5 wherein the coupling arrangement includes a further coupling member carried by each standard of the support structure at the first support portion of the support structure, the further coupling members being complementary to corresponding coupling members on the lateral member for enabling selective coupling and uncoupling of the support structure and the lateral member such that upon selective uncoupling of the first support portion of the support structure from the couplings, the support structure and the handgrip bar will be released for stowing apart from the dinghy.

7. The boarding aid of claim 4 wherein the lateral member comprises a platform constructed of a substantially rigid material dimensioned and configured for providing the person with a firm and stable footing upon stepping aboard and debarking from the dinghy.

8. The boarding aid of claim 7 wherein the affixation positions are located intermediate the floor and the upper edges of the pontoon bow sections such that the platform will be placed intermediate the floor and the upper edges upon coupling the lateral member with the pontoon bow sections.

9. The boarding aid of claim 8 wherein the support structure includes support segments angled relative to one another to locate the handgrip bar altitudinally above the bow of the dinghy when the boarding aid is coupled to the dinghy.

10. A boarding aid for assisting a person in embarking on and disembarking from a dinghy having a bow, adjacent inflatable pontoon bow sections spaced apart in lateral directions by a predetermined lateral distance, a floor extending laterally between the pontoon bow sections, the pontoon bow sections extending altitudinally upward from the floor to corresponding upper edges located at a predetermined height above the floor, and a platform secured to the dinghy adjacent the bow, the platform extending laterally between the pontoon bow sections and having laterally opposite ends, the boarding aid comprising:

a handgrip bar having a length extending between opposite bar portions, a support structure having a first support portion for juxtaposition with the pontoon bow sections, and a second support portion spaced from the first support portion along a longitudinal direction, the support structure being joined with the handgrip bar adjacent the second support portion of the support structure such that the handgrip bar extends laterally with respect to the longitudinal direction of the support structure; and a coupling arrangement for coupling the first support portion of the support structure with the dinghy at a coupling location on the platform and juxtaposed with the bow;

the coupling arrangement including at least one coupling member on the platform at the coupling location, the coupling member being configured and dimensioned for securing the first support portion of the support structure to the platform with the support structure fixed against movement relative to the platform;

the support structure having a prescribed length between the first and second support portions such that with the first support portion of the support structure coupled with the platform, the support structure will be installed on the dinghy, fixed against movement relative to the platform, with the length of the handgrip bar extending laterally essentially in alignment with the lateral directions and placed at an elevated position located a substantial altitudinal distance above the bow, so as to be accessible for ready grasping by a person remaining essentially erect as the person steps aboard or debarks from the dinghy adjacent the bow.

11. The boarding aid of claim 10 wherein the coupling arrangement includes a further coupling member carried by the support structure at the first support portion of the support structure, the further coupling member being complementary to the coupling member on the platform for enabling selective coupling and uncoupling of the support structure and the platform such that upon selective uncoupling of the first support portion of the support structure from the platform, the support structure and the handgrip bar will be released for stowing apart from the dinghy.

12. The boarding aid of claim 10 wherein the support structure includes a pair of standards, each standard depending from the handgrip bar at a corresponding bar portion such that the support structure follows a generally inverted U-shaped configuration.

13. The boarding aid of claim 12 wherein the coupling arrangement includes a further coupling member carried by the support structure on each standard, at the first support portion of the support structure, the further coupling members being complementary to corresponding coupling members on the platform for enabling selective coupling and uncoupling of the support structure and the platform such that upon selective uncoupling of the first support portion of the support structure from the platform, the support structure and the handgrip bar will be released for stowing apart from the dinghy.

14. The boarding aid of claim 13 wherein the support structure includes support segments angled relative to one another to locate the handgrip bar altitudinally above the bow of the dinghy when the boarding aid is coupled to the dinghy.

15. The boarding aid of claim 10 wherein the support structure includes support segments angled relative to one another to locate the handgrip bar altitudinally above the bow of the dinghy when the boarding aid is coupled to the dinghy.

* * * * *